US011168541B2

(12) United States Patent
Scott

(10) Patent No.: US 11,168,541 B2
(45) Date of Patent: Nov. 9, 2021

(54) PRESSURE RETENTION MANIFOLD FOR SAND CONTROL SCREENS

(71) Applicant: HALLIBURTON ENERGY SERVICES, INC., Houston, TX (US)

(72) Inventor: Brian Scott, Scotland (GB)

(73) Assignee: HALLIBURTON ENERGY SERVICES, INC., Houston ( * ) Notice: Subject to any disclaimer, the term of this patent is extended or adjusted under 35 U.S.C. 154(b) by 248 days.

(21) Appl. No.: 16/470,113

(22) PCT Filed: Jul. 30, 2018

(86) PCT No.: PCT/US2018/044292
§ 371 (c)(1),
(2) Date: Jun. 14, 2019

(87) PCT Pub. No.: WO2020/027770
PCT Pub. Date: Feb. 6, 2020

(65) Prior Publication Data
US 2021/0156229 A1 May 27, 2021

(51) Int. Cl.
*E21B 37/08* (2006.01)
*E21B 23/06* (2006.01)
*E21B 33/12* (2006.01)

(52) U.S. Cl.
CPC ..... *E21B 37/08* (2013.01); *E21B 23/06* (2013.01); *E21B 33/12* (2013.01); *E21B 2200/08* (2020.05)

(58) Field of Classification Search
CPC ..... E21B 37/08; E21B 33/12; E21B 23/06; E21B 2200/08
See application file for complete search history.

(56) References Cited

U.S. PATENT DOCUMENTS

| | | | | |
|---|---|---|---|---|
| 9,151,143 | B2 * | 10/2015 | Holderman | E21B 34/06 |
| 9,638,013 | B2 * | 5/2017 | Yeh | E21B 43/08 |
| 2007/0039741 | A1 | 2/2007 | Hailey, Jr. | |
| 2008/0169099 | A1 * | 7/2008 | Pensgaard | E21B 33/138 166/285 |
| 2009/0283271 | A1 | 11/2009 | Langeslag | |

(Continued)

OTHER PUBLICATIONS

International Search Report and Written Opinion of the International Searching Authority, dated Apr. 26, 2019, PCT/US2018/044292, 13 pages, ISR/KR.

*Primary Examiner* — Steven A MacDonald

(57) ABSTRACT

A screen assembly includes a pipe forming a first passageway and a first plurality of passageways extending between internal and external surfaces of the pipe to define a first portion of the pipe; a tubular disposed about the first portion, wherein the tubular forms a second passageway and a second plurality of passageways extending between external and internal surfaces of the tubular; and a housing concentrically disposed about the tubular to form a chamber that is between the tubular and the housing and that is in fluid communication with a screen jacket exit. When in a first configuration, dissolvable plugs are accommodated within the second plurality of passageways to fluidically isolate the external surface of the tubular from the first passageway. When in the second configuration, the screen jacket exit is in fluid communication with the first passageway via the chamber and the first and second plurality of passageways.

20 Claims, 5 Drawing Sheets

(56) References Cited

U.S. PATENT DOCUMENTS

| | | | | |
|---|---|---|---|---|
| 2012/0067574 | A1 | 3/2012 | Lopez | |
| 2014/0020898 | A1* | 1/2014 | Holderman | E21B 43/08 166/304 |
| 2014/0262322 | A1* | 9/2014 | Yeh | E21B 43/08 166/373 |
| 2015/0330191 | A1 | 11/2015 | Holderman | |
| 2016/0230509 | A1* | 8/2016 | Lopez | E21B 41/00 |

* cited by examiner

PRESSURE RETENTION MANIFOLD FOR SAND CONTROL SCREENS

PRIORITY

The present application is a U.S. National Stage patent application of International Patent Application No. PCT/US2018/044292, filed on Jul. 30, 2018, the benefit of which is claimed and the disclosure of which is incorporated herein by reference in its entirety.

TECHNICAL FIELD

The present disclosure relates generally to a bottom hole assembly having a screen assembly alternatively capable of maintaining a minimum pressure within a fluid passageway of the bottom hole assembly and placing the screen assembly in fluid communication with the fluid passageway of the bottom hole assembly.

BACKGROUND

In the process of completing an oil or gas well, a tubular is run downhole and used to communicate produced hydrocarbon fluids from the formation to the surface. Typically, this tubular includes a screen assembly that controls and limits debris, such as gravel, sand, and other particulate matter, from entering the tubular. Generally, when running the tubular and screen assembly downhole, the screen assembly allows for a downhole fluid to enter the tubular via openings in the screen assembly. A wash pipe is often installed in the interior of the tubular to provide a method of circulation from the surface to the end of the screen assembly, which enables the circulation of fluids into the wellbore (for stimulation, etc.), and/or provides circulation to aid the deployment of the screen assembly to a final depth as having the circulation and washdown capability can clear any debris and enable screen deployment.

DETAILED DESCRIPTION

Figure 1:
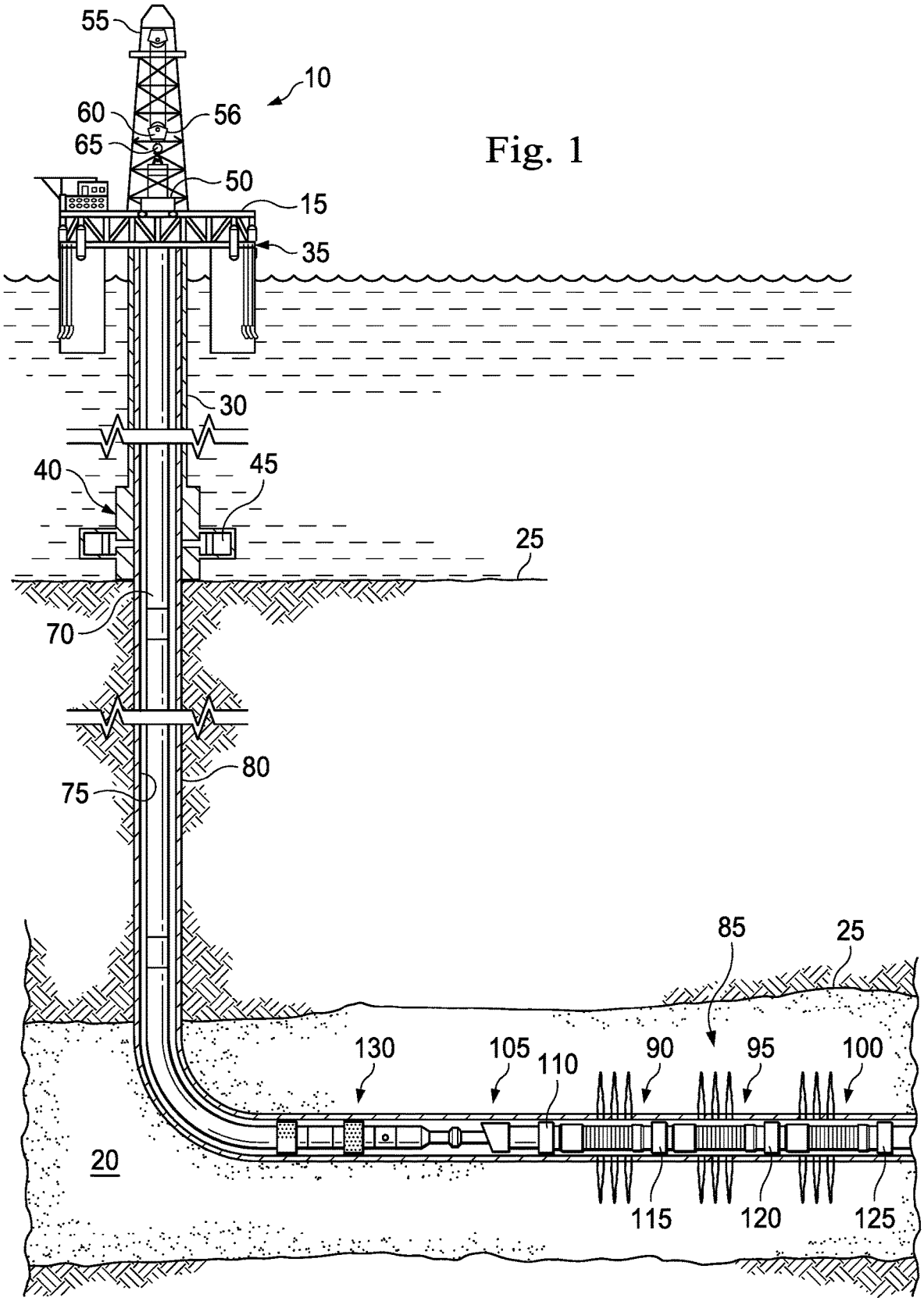
FIG. 1 is a schematic illustration of an offshore oil and gas platform operably coupled to a screen assembly according to an embodiment of the present disclosure.

Referring initially to FIG. 1, an upper completion assembly is installed in a well having a lower completion assembly disposed therein from an offshore oil or gas platform that is schematically illustrated and generally designated 10. However, and in some cases, a single trip completion assembly (i.e., not having separate upper and lower completion assemblies) are installed in the well. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending tubing string 70.

A wellbore 75 extends through the various earth strata including the formation 20 and has a casing string 80 cemented therein. Disposed in a substantially horizontal portion of the wellbore 75 is a lower completion assembly 85 that includes at least one screen assembly, such as screen assembly 90 or screen assembly 95 or screen assembly 100, and may include various other components, such as a latch subassembly 105, a packer 110, a packer 115, a packer 120, and a packer 125.

Disposed in the wellbore 75 is an upper completion assembly 130 that couples to the latch subassembly 105 to place the upper completion assembly 130 and the tubing string 70 in communication with the lower completion assembly 85. In some embodiments, the latch subassembly 105 is omitted.

Even though FIG. 1 depicts a horizontal wellbore, it should be understood by those skilled in the art that the apparatus according to the present disclosure is equally well suited for use in wellbores having other orientations including vertical wellbores, slanted wellbores, uphill wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
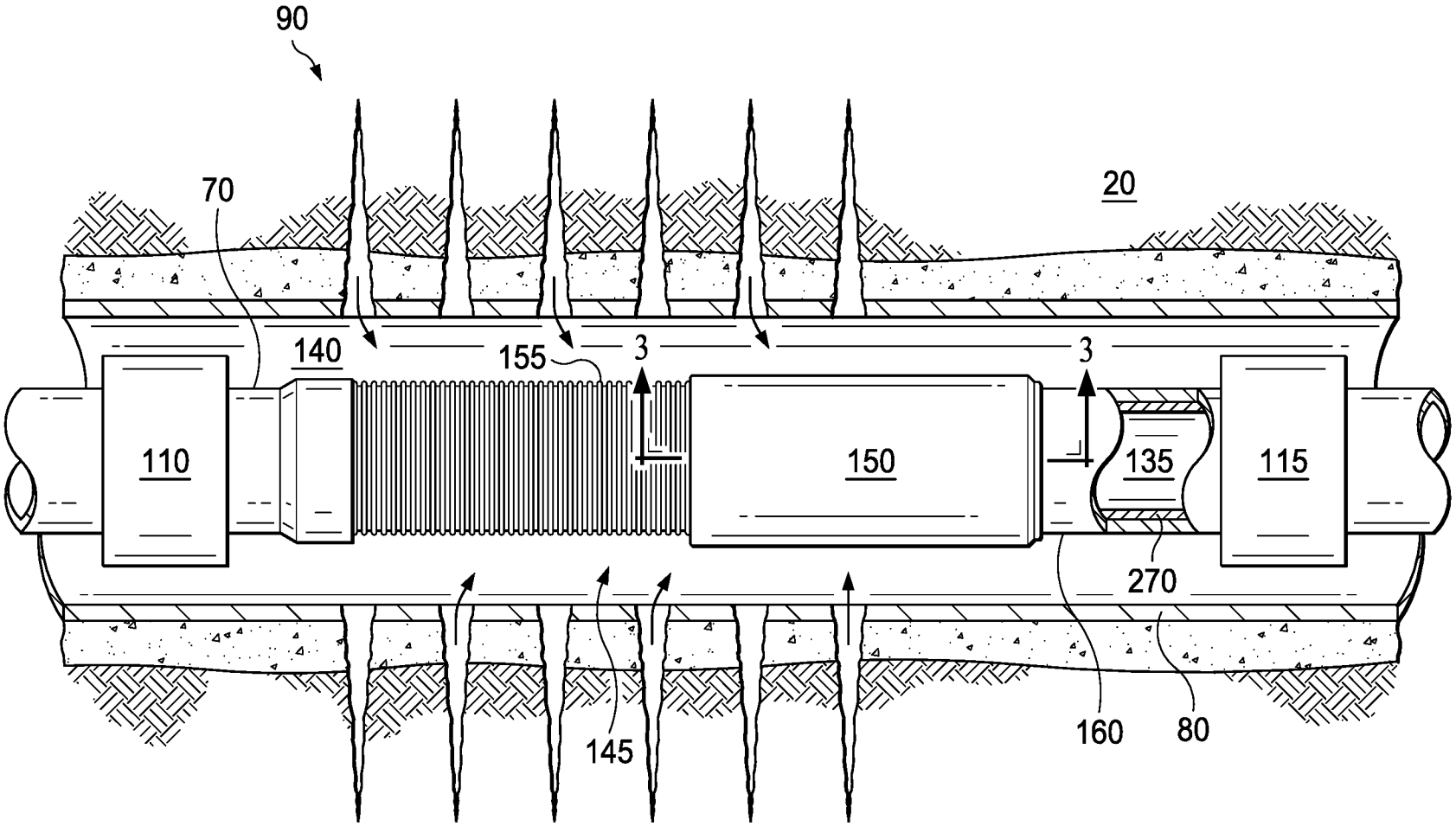
FIG. 2 illustrates a side view of the screen assembly of FIG. 1 in a wellbore, according to an example embodiment of the present disclosure.

FIG. 2 illustrates the screen assembly 90 according to an example embodiment. The screen assembly 90 filters debris within a formation fluid from the formation 20 and allows the filtered formation fluid to enter an interior flow passage 135 of the tubing string 70 (such as a production tubing string, liner string, etc.). As shown, an annulus 140 is formed radially between the tubing string 70 and the casing string 80. However, the annulus 140 may be formed radially between the tubing string 70 and the formation 20 when the casing string 80 is omitted in open hole completions. The fluid flows from the formation 20 into the interior flow passage 135 through the screen assembly 90. The screen assembly 90 generally includes a screen jacket 145 and pressure retention manifold 150. The screen jacket 145 prevents or at least reduces the amount of debris, such as gravel, sand, fines, and other particulate matter, from entering the interior flow passage 135. In one or more embodiments, the fluid passes through the screen jacket 145 then flows through the manifold 150 and into the interior flow passage 135 for eventual production to the surface. However, the manifold 150 may be used in a wide variety of assemblies, such as for example an assembly that is installed or used in an injector well. The screen jacket 145 may include or be an elongated tubular screen member 155 concentrically disposed about the base pipe 160 that forms a portion of the tubing string 70.

Figure 3:
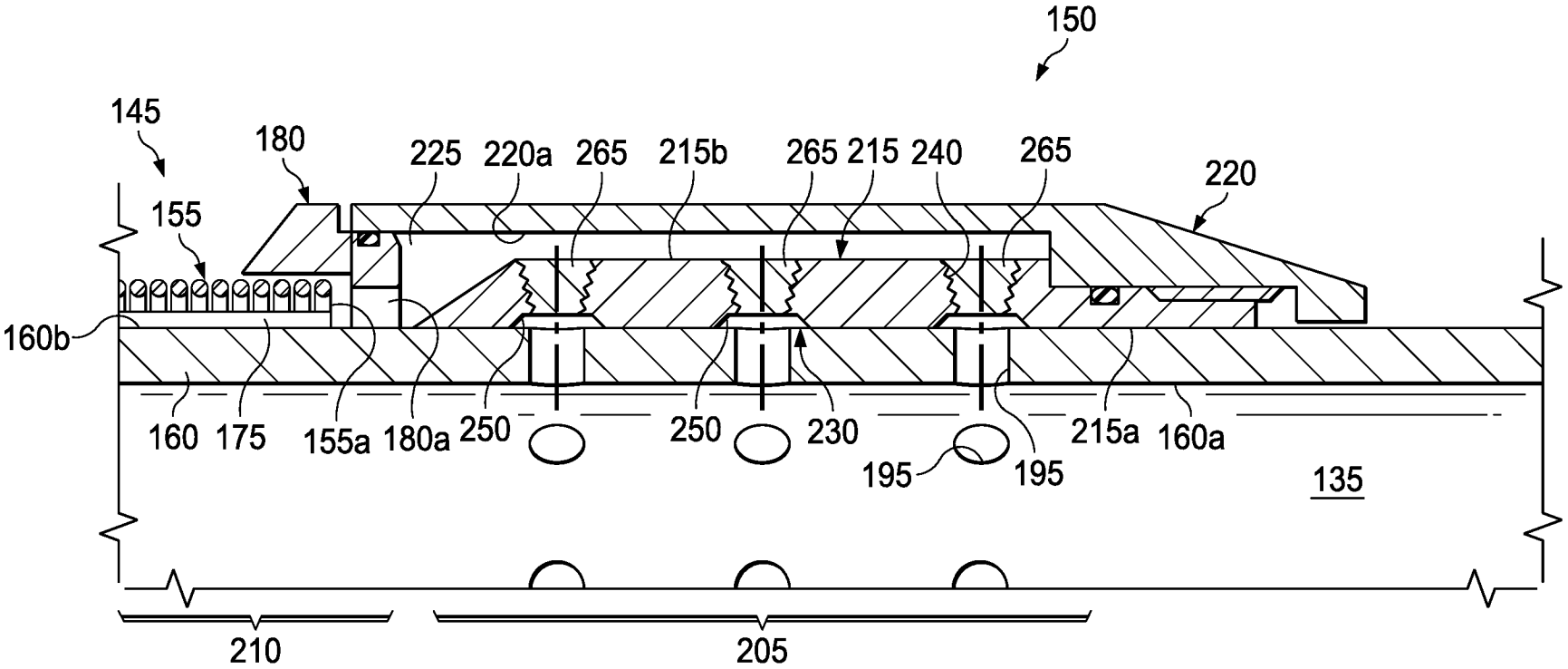
FIG. 3 illustrates a partial sectional view of the screen assembly of FIG. 2 in a first configuration, according to an example embodiment of the present disclosure.

FIG. 3 illustrates a more detailed view of the screen assembly 90 according to an example embodiment. In one or more embodiments, the screen jacket 145 of the screen assembly 90 is the member 155 disposed on the base pipe 160 so as to define a flow path or passage 175 between the member 155 and the base pipe 160. The passage 175 is formed to direct fluid flow towards the interior flow passage 135 via the manifold 150. A jacket adapter 180 is disposed about the exterior surface of the screen member 155 to secure the screen member 155 to the base pipe 160 and/or the manifold 150.

In an example embodiment, the base pipe 160 forms passageways 195 extending between an external surface 160*b* of the base pipe 160 and the internal surface 160*a* of the base pipe. Generally, the passageways 195 are spaced across a fluid receiving portion 205 of the base pipe 160. In some embodiments, the passageways 195 are spaced circumferentially and longitudinally along the base pipe 160. The base pipe also forms another portion 210 that is a solid-walled portion of the base pipe 160. That is, no passageways or fluid passageways are formed through the wall forming the second portion 210 of the base pipe 160. Generally, the screen member 155 is positioned over the second portion 210 of the base pipe 160 and the external surface 160*b* of the base pipe 160 forms a portion of the fluid passageway 175.

In an example embodiment, the manifold 150 includes a tubular 215 and a housing 220 extending over the tubular 215 to form a chamber 225. Generally, the tubular 215 is concentrically disposed about the first portion 205 of the base pipe 160 and forms an interior passageway 230 defined by an internal surface 215*a* of the tubular 215. The tubular 215 also forms passageways 240 extending between an external surface 215*b* of the tubular 215 and the internal surface 215*a* of the tubular 215. In some embodiments, the tubular 215 is welded to the base pipe 160, but other methods of attaching the tubular 215 to the base pipe 160 are also contemplated here. In some embodiments, the internal surface 215*a* of the tubular 215 forms one or more recessed annular chambers 250, with each of the chambers 250 extends around the internal diameter of the tubular 215. Generally, the recessed annular chambers 250 are aligned longitudinally with at least one of the passageways 195 and with at least one of the passageways 240. In some embodiments, one or more of the passageways 240 has a tapered shape in a cross-section view of the tubular, such as a longitudinal or radial cross section view. Moreover, in some embodiments, one or more of the passageways 240 has a threaded surface that is configured to engage and secure a threaded plug. While a longitudinal axis of the passageways 240 and 195 are shown perpendicular to a longitudinal axis of the base pipe 160, the axes may intersect the passageway 135 at a variety of angles. In some embodiments, the passageways 240 are spaced circumferentially and longitudinally along the tubular 215 in a pattern similar to the spacing of the passageways 195 of the base pipe 160. However, if the passageways 195 and 240 are offset and not aligned (circumferentially and/or longitudinally), the annular chambers 250 encourage or provide for fluid communication between the passageways 240 and 195. Generally, the housing 220 is concentrically disposed about the tubular 215 and the base pipe 160 to form the chamber 225 between the external surface 215*b* of the tubular 215 and an internal surface 220*a* of the housing 220. The housing 220 may be threadably coupled to the tubular 215 and/or the base pipe 160. The chamber 225 is in fluid communication with the fluid passageway 175 via a screen jacket exit or a screen exit 155*a*, and in some embodiments, a passageway 180*a* formed in the jacket adaptor 180. As such, the filtered fluid that is accommodated in the fluid passageway 175 is capable of entering the chamber 225. The housing 220 is removable or detachable from the tubular 215 to expose the passageways 240. Seals 260 are positioned between the internal surface 220*a* of the housing 220 and the tubular 215 and jacket adaptor 180. In some embodiments, the seal(s) 260 fluidically isolate the chamber 225 from the annulus 140 except for the passageway 180*a* and screen exit 155*a*. However, in some embodiments, a pinhole is formed in the housing 220.

Generally, the pressure manifold 150 has a first configuration and a second configuration. In the first configuration and as illustrated in FIG. 3, plugs 265 are accommodated within the passageways 240 to fluidically isolate the chamber 225 and annulus 140 from the passageway 135. That is, the plugs 265 fluidically isolate the external surface 215*b* of the tubular 215 from the passageway 135 of the base pipe 160. In some embodiments, the plugs 265 are threadably engaged with the tubular 215 and are tapered in shape, to mirror the shape of the passageways 240. That is, the passageways 240 are threaded and the plugs 265 are threaded. In some embodiments, the plugs 265 are dissolvable plugs. That is, upon exposure to an acid wash or other activating event, the plugs 265 dissolve, with remnants passing through the passageways 240 and 195 and into the passageway 135. In some embodiments, a portion of the plugs 265 are permanent plugs. That is, permanent plugs will not dissolve in the same manner as the dissolvable plugs and will remain within the passageways 240. The number of passageways 240 that accommodate dissolvable plugs and permanents plugs is based on a desired flow setting. In some embodiments, the adjustment of the flow settings occurs at the surface of the well. That is, the passageways can be plugged (with either permanent or dissolvable plugs) at the surface of the well. The plugs 265, and the way in which the plugs 265 are attached to the tubular 215, are configured to withstand and remain in position even while the passageway 135 is pressurized.

Figure 4:
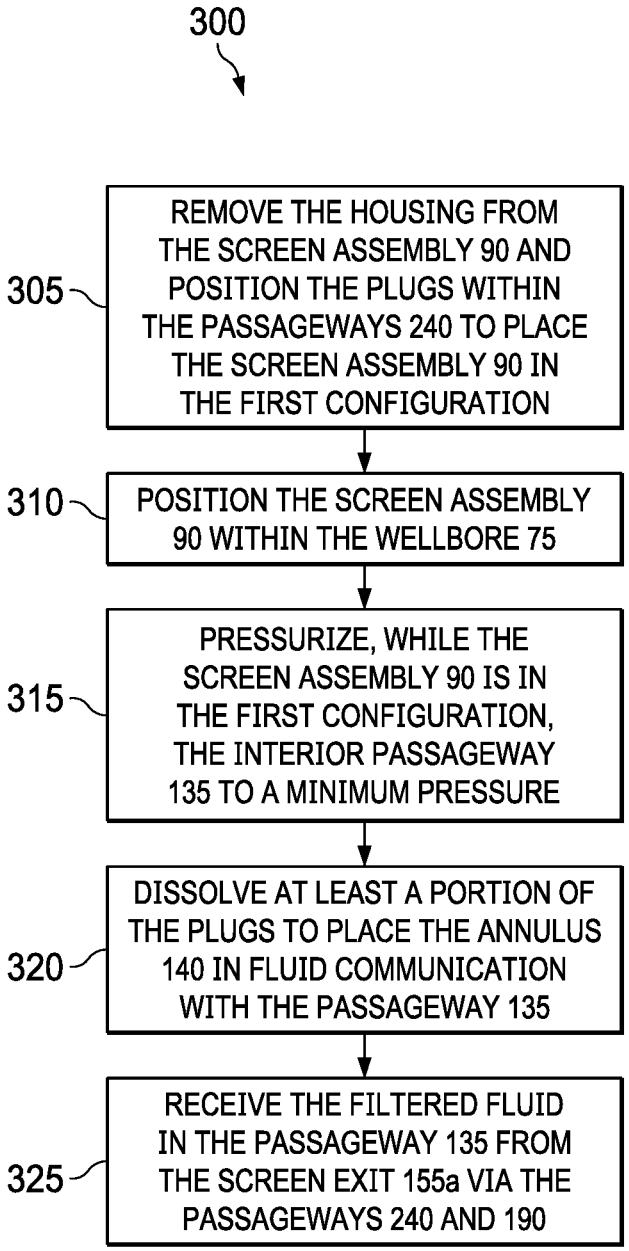
FIG. 4 is a flow chart illustration of a method of operating the apparatus of FIGS. 1-3, according to an example embodiment.

In an example embodiment, as illustrated in FIG. 4 with continuing reference to FIGS. 1-3, a method 300 of operating the screen assembly 90 includes removing the housing 220 from the screen assembly 90 and positioning the plugs 265 within the passageways 240 to place the screen assembly 90 in the first configuration at step 305; positioning the screen assembly 90 within the wellbore 75 at step 310; pressurizing, while the screen assembly 90 is in the first configuration, the interior passageway 135 to a minimum pressure at step 315; dissolving at least a portion of the plugs 265 to place the annulus 140 in fluid communication with the passageway 135 at step 320; and receiving the filtered fluid in the passageway 135 from the screen exit 155*a* via the passageways 240 and 190 at step 325.

At the step 305, the housing 220 is removed from the screen assembly 90 and the plugs 265 are positioned within the passageways 240 to place the screen assembly 90 in the first configuration. Moreover, the step 305 includes selecting a flow setting for the screen assembly 90. The flow setting is based, at least in part, on the number of passageways 240 to be plugged with permanent plugs and with dissolvable plugs. As a different number of passageways 240 can be plugged with permanent plugs to result in different flow settings, there are a variety or number of flow setting options associated with the screen assembly 90. In some embodiments, the plugging of the passageways 240 using the plugs 265 is performed at the surface of the well. That is, the housing 220 is removed to expose the passageways 240, thereby allowing an operator to plug a number of the passageways 240. The housing 220 is then reattached to the screen assembly 90.

At the step 310, the screen assembly 90 is positioned within the wellbore 75. Positioning the screen assembly 90 within the wellbore 75 defines the annulus 140.

At the step 315, the passageway 135 is pressurized to the minimum pressure. Generally, pressurizing the passageway 135 to the minimum pressure includes pumping a mud or fluid down the tubing string 70 through the passageway 135. As the screen assembly 90 is in the first configuration and as the plugs 265 are pressure rated to a pressure that is greater than the minimum pressure, the screen assembly 90 is configured to pressurize and maintain the passageway 135 to the minimum pressure. In some embodiments, the packer 110 is in fluid communication with the interior passageway 135, and pressurizing the first passageway 135 to the minimum pressure results in setting the packer 110 relative the wellbore 75. Thus, the minimum pressure in some embodiments is greater than or equal to a pressure associated with setting the packer 110. In some embodiments, the step 315 may be omitted. In some embodiments and instead of the step 315, any number of other deployment operations is completed.

Figure 5:
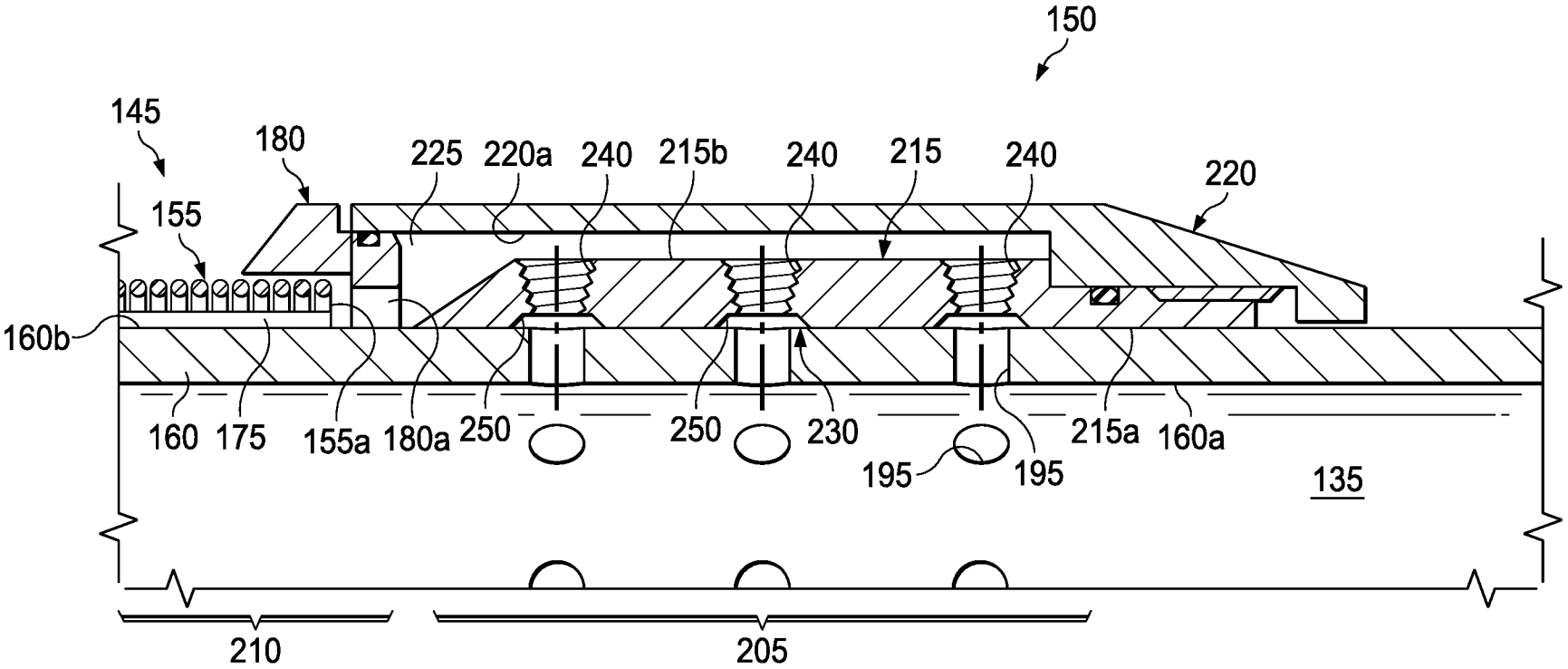
FIG. 5 illustrates a partial sectional view of the screen assembly of FIG. 2 in a second configuration, according to an example embodiment of the present disclosure.

At the step 320, at least a portion of the plugs 265 are dissolved to place the screen assembly 90 in the second configuration as illustrated in FIG. 5. In some embodiments, dissolving the dissolvable plugs 265 includes exposing the dissolvable plugs to an organic or inorganic acid. However, other methods of dissolving or breaking apart the plugs 265 are considered here, such as exposure to a specific temperature or change in temperature.

At the step 325, the filtered fluid is received in the interior passageway 135 from the screen exit 155*a* via the passageways 240 and 195 and the chamber 225. The step 325 also includes passing a formation fluid through the screen member 155 to filter the formation fluid and passing the filtered formation fluid through the screen exit 155*a* and to the chamber 225.

While only three rows of passageways 240, 195 are shown spaced longitudinally along the tubular 215 and base pipe 160, any number of rows of passageways 240 and 195 may be included or formed in the tubular 215 and base pipe 160. Additionally, pressurizing the passageway 135 to the minimum pressure is not limited to activating the packers 110, 115, 120 and 125 and instead, may be used during fracturing operations, etc.

In an example embodiment, during the operation of the apparatus 90 and/or the execution of the method 300, the manifold 150 can fluidically isolating the passageway 135 from the annulus 140 to: prevent accumulation of debris—from a circulation fluid, such as mud—within the screen assembly 90 during installation and positioning of the screen assembly 90 downhole; allow circulation without a wash pipe/string for circulation; and/or allow for the passageway 135 to be pressurized and maintain the pressure for setting packers or fracturing. Specifically, as the screen assembly 90 is in the first configuration during deployment, the need to run a wash string is significantly reduced or eliminated. The elimination of the running of a wash string saves time and expense.

Thus a screen assembly has been described. Embodiments of the screen assembly may generally include a base pipe forming: a first interior passageway defined by an internal surface of the base pipe; and a first plurality of passageways extending between an external surface of the base pipe and the internal surface of the base pipe wherein the first plurality of passageways are spaced across a first portion of the base pipe; a tubular that is concentrically disposed about the first portion of the base pipe, wherein the tubular forms: a second interior passageway defined by an internal surface of the tubular; and a second plurality of passageways extending between an external surface of the tubular and the internal surface of the tubular; and a housing concentrically disposed about the tubular and the base pipe to form a chamber between the external surface of the tubular and an internal surface of the housing, wherein the chamber is in fluid communication with a screen jacket exit; wherein the manifold has a first configuration and a second configuration; wherein, when in the first configuration, the manifold further comprises a plurality of plugs and wherein a plug from the plurality of plugs is accommodated within a corresponding hole of the second plurality of passageways to fluidically isolate the external surface of the tubular from the first interior passageway of the base pipe; and wherein, when in the second configuration, the screen jacket exit is in fluid communication with the first interior passageway of the base pipe via the chamber, first plurality of passageways, and the second plurality of passageways. Any of the foregoing embodiments may include any one of the following elements, alone or in combination with each other:

- In the first configuration, the pressure retention manifold is configured to maintain a pressure within the first interior passageway.
- The pressure is greater than or equal to a pressure associated with setting a packer.
- The screen assembly also includes a screen jacket that forms the screen jacket exit, wherein the screen jacket is concentrically disposed about a second portion of the base pipe that is a solid-walled portion of the base pipe.
- The internal surface of the tubular forms a recessed annular chamber within a wall of the tubular, and wherein the annular chamber is aligned with at least one of the passageways in the first plurality of passageways and with at least one of the passageways of the second plurality of passageways.
- The first plurality of passageways are circumferentially spaced and longitudinally spaced along the base pipe within the first portion of the base pipe.
- The second plurality of passageways has a tapered shape in a cross-section view of the tubular.
- At least a portion of the plurality of plugs are dissolvable plugs.
- At least one plug from the plurality of plugs threadably engages at least one hole of the second plurality of passageways.

Thus a method has been described. Embodiments of the method may generally include positioning a bottom hole assembly within a wellbore of a well to define an annulus between an external surface of the bottom hole assembly and an internal surface of the wellbore, wherein the bottom hole assembly comprises: a base pipe forming: a first interior passageway defined by an internal surface of the base pipe; and a first plurality of passageways extending between an external surface of the base pipe and the internal surface of the base pipe wherein the first plurality of passageways are spaced across a first portion of the base pipe; a tubular that is concentrically disposed about the first portion of the base pipe, wherein the tubular forms: a second interior passageway defined by an internal surface of the base pipe; and a second plurality of passageways extending between an external surface of the tubular and the internal surface of the tubular; a housing concentrically disposed about the tubular and the base pipe to form a chamber between the external surface of the tubular and an internal surface of the housing, wherein the chamber is in fluid communication with a screen jacket exit; and a plurality of plugs, with a plug from the plurality of plugs is accommodated within a corresponding hole of the second plurality of passageways to fluidically isolate the external surface of the tubular from the first interior passageway of the base pipe; pressurizing, while the plurality of plugs are accommodated within the second plurality of passageways, the first interior passageway of the base pipe to a minimum pressure; and dissolving at least a portion of the plurality of plugs to place the annulus in fluid communication with the first interior passageway. Any of the foregoing embodiments may include any one of the following elements, alone or in combination with each other:

- The bottom hole assembly further comprises a packer assembly in fluid communication with the first interior passageway, wherein pressurizing, while the plurality of plugs are accommodated within the second plurality of passageways, to the minimum pressure results in setting the packer assembly relative the wellbore.
- The method also includes prior to positioning the bottom hole assembly in the wellbore, removing the housing from the bottom hole assembly and positioning one or more of the plurality of plugs within the second plurality of passageways.
- Positioning the one or more of the plurality of plugs in the second plurality of passageways comprises threadably engaging the one or more of the plurality of plugs and at least one hole of the second plurality of passageways.
- The method also includes receiving a fluid in the first interior passageway from the screen jacket exit via the first plurality of passageways and the second plurality of passageways.
- The internal surface of the tubular forms a recessed annular chamber within a wall of the tubular, wherein the annular chamber is aligned with at least one of the passageways in the first plurality of passageways and with at least one of the passageways of the second plurality of passageways; and wherein receiving the fluid in the first interior passageway from the screen jacket exit is also via the annular chamber.
- The first plurality of passageways are circumferentially spaced and longitudinally spaced along the base pipe within the first portion of the base pipe.
- The second plurality of passageways has a tapered shape in a cross-section view of the tubular.
- At least a portion of the plurality of plugs are dissolvable plugs.
- The method also includes a formation fluid passing through a screen jacket towards the screen jacket exit to filter the formation fluid.
- Positioning the bottom hole assembly within the wellbore while the external surface of the tubular is fluidically isolated from the first interior passageway of the base pipe prevents debris from a downhole fluid from entering the screen jacket and the second plurality of passageways.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those skilled in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

Illustrative embodiments and related methods of the present disclosure are described below as they might be employed in a pressure actuated inflow control device. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

What is claimed is:

1. A screen assembly, comprising:

a base pipe forming:

a first interior passageway defined by an internal surface of the base pipe; and a first plurality of passageways extending between an external surface of the base pipe and the internal surface of the base pipe, wherein the first plurality of passageways are spaced across a first portion of the base pipe;

a tubular that is concentrically disposed about the first portion of the base pipe, wherein the tubular forms a second plurality of passageways extending between an external surface of the tubular and the internal surface of the tubular; and a housing concentrically disposed about the tubular and the base pipe to form a chamber between the external surface of the tubular and an internal surface of the housing, wherein the chamber is in fluid communication with a screen jacket exit;

wherein the screen assembly has a first configuration and a second configuration;

wherein, when in the first configuration, the screen assembly further comprises a plurality of plugs and wherein a plug from the plurality of plugs is accommodated within a corresponding passageway of the second plurality of passageways to fluidically isolate the external surface of the tubular from the first interior passageway of the base pipe;

wherein, when in the second configuration, the screen jacket exit is in fluid communication with the first interior passageway of the base pipe via the chamber, the first plurality of passageways, and the second plurality of passageways; and wherein at least a portion of the plurality of plugs are dissolvable plugs.

2. The screen assembly of claim 1, wherein in the first configuration, the screen assembly is deployed in a wellbore and the screen assembly is configured to maintain a pressure within the first interior passageway.

3. The screen assembly of claim 1, further comprising a screen jacket that forms the screen jacket exit, wherein the screen jacket is concentrically disposed about a second portion of the base pipe that is a solid-walled portion of the base pipe.

4. The screen assembly of claim 1, wherein the internal surface of the tubular forms a recessed annular chamber within a wall of the tubular, and wherein the annular chamber is aligned with at least one of the passageways in the first plurality of passageways and with at least one of the passageways of the second plurality of passageways.

5. The screen assembly of claim 1, wherein the first plurality of passageways are circumferentially spaced and longitudinally spaced along the base pipe within the first portion of the base pipe.

6. The screen assembly of claim 1, wherein the second plurality of passageways has a tapered shape in a cross-section view of the tubular.

7. The screen assembly of claim 1, wherein at least one plug from the plurality of plugs threadably engages at least one passageway of the second plurality of passageways.

8. The screen assembly of claim 1, wherein the housing is directly coupled to the tubular via threads.

9. A method, comprising:

positioning a bottom hole assembly within a wellbore of a well to define an annulus between an external surface of the bottom hole assembly and an internal surface of the wellbore, wherein the bottom hole assembly comprises:

a base pipe forming:

a first interior passageway defined by an internal surface of the base pipe; and a first plurality of passageways extending between an external surface of the base pipe and the internal surface of the base pipe, wherein the first plurality of passageways are spaced across a first portion of the base pipe;

a tubular that is concentrically disposed about the first portion of the base pipe, wherein the tubular forms a second plurality of passageways extending between an external surface of the tubular and the internal surface of the tubular;

a housing concentrically disposed about the tubular and the base pipe to form a chamber between the external surface of the tubular and an internal surface of the housing, wherein the chamber is in fluid communication with a screen jacket exit; and a plurality of plugs, wherein a plug from the plurality of plugs is accommodated within a corresponding passageway of the second plurality of passageways to fluidically isolate the external surface of the tubular from the first interior passageway of the base pipe;

pressurizing, while the plurality of plugs is accommodated within the second plurality of passageways, the first interior passageway of the base pipe to a minimum pressure; and dissolving at least a portion of the plurality of plugs to place the annulus in fluid communication with the first interior passageway.

10. The method of claim 9, wherein the bottom hole assembly further comprises a packer in fluid communication with the first interior passageway, wherein pressurizing, while the plurality of plugs is accommodated within the second plurality of passageways, to the minimum pressure results in setting the packer relative the wellbore.

11. The method of claim 10, further comprising, prior to positioning the bottom hole assembly in the wellbore, removing the housing from the bottom hole assembly and positioning one or more of the plurality of plugs within the second plurality of passageways.

12. The method of claim 11, wherein positioning the one or more of the plurality of plugs in the second plurality of passageways comprises threadably engaging the one or more of the plurality of plugs into at least one passageway of the second plurality of passageways.

13. The method of claim 9, further comprising receiving a fluid in the first interior passageway from the screen jacket exit via the first plurality of passageways and the second plurality of passageways.

14. The method of claim 13, wherein the internal surface of the tubular forms a recessed annular chamber within a wall of the tubular, wherein the annular chamber is aligned with at least one of the passageways in the first plurality of passageways and is aligned with at least one of the passageways of the second plurality of passageways; and wherein receiving the fluid in the first interior passageway from the screen jacket exit is also via the annular chamber.

15. The method of claim 9, wherein the first plurality of passageways are circumferentially spaced and longitudinally spaced along the base pipe within the first portion of the base pipe.

16. The method of claim 9, wherein the second plurality of passageways has a tapered shape in a cross-section view of the tubular.

17. The method of claim 9, wherein at least the portion of the plurality of plugs are dissolvable plugs.

18. The method of claim 9, further comprising a formation fluid passing through a screen jacket towards the screen jacket exit to filter the formation fluid.

19. The method of claim 18, wherein positioning the bottom hole assembly within the wellbore while the external surface of the tubular is fluidically isolated from the first interior passageway of the base pipe prevents debris from a downhole fluid from entering the screen jacket and the second plurality of passageways.

20. The method of claim 9, wherein the housing is directly coupled to the tubular via threads.

* * * * *